US006401563B1

(12) United States Patent
Franklin

(10) Patent No.: US 6,401,563 B1
(45) Date of Patent: Jun. 11, 2002

(54) ACTUATING MECHANISM FOR A SLIDABLE NOZZLE RING

(75) Inventor: Philip C. Franklin, Huddersfield (GB)

(73) Assignee: Holset Engineering Company, Ltd., Huddersfield (GB)

( * ) Notice: Subject to any disclaimer, the term of this patent is extended or adjusted under 35 U.S.C. 154(b) by 0 days.

(21) Appl. No.: 09/202,733

(22) PCT Filed: Mar. 25, 1998

(86) PCT No.: PCT/GB98/00918

§ 371 (c)(1),
(2), (4) Date: Jun. 4, 1999

(87) PCT Pub. No.: WO98/46862

PCT Pub. Date: Oct. 22, 1998

(30) Foreign Application Priority Data

Apr. 12, 1997 (GB) ..... 9707453

(51) Int. Cl.[7] ..... F02D 23/00; F01B 25/02

(52) U.S. Cl. ..... 74/469; 60/602; 403/28; 403/113; 415/157; 415/158

(58) Field of Search ..... 60/602; 403/62, 403/65, 112, 113, 119, 120, 145, 28, 29, 30; 415/157, 158; 74/469, 519

(56) References Cited

U.S. PATENT DOCUMENTS

| | | | | | |
|---|---|---|---|---|---|
| 2,745,130 | A | * | 5/1956 | Oishei | 15/253 |
| 3,079,127 | A | * | 2/1963 | Rowlett et al. | 253/52 |
| 4,586,336 | A | * | 5/1986 | Horler | 60/602 |
| 5,214,920 | A | * | 6/1993 | Leavesley | 60/602 |

FOREIGN PATENT DOCUMENTS

| | | | |
|---|---|---|---|
| EP | 342888 | * | 11/1989 |
| EP | 571205 | * | 11/1993 |
| GB | 4218229 | * | 4/1993 |

* cited by examiner

*Primary Examiner*—Allan D. Herrmann
(74) *Attorney, Agent, or Firm*—Gary M. Gron

(57) ABSTRACT

A linkage mechanism for linking for example actuator rods to the nozzle ring of a variable geometry turbine. First and second components of the mechanism are interconnected by at least two links which are displaceable in a predetermined direction relative to the first component and connected at spaced apart locations to the second component. At least one of the links incorporates an element which is pivotal relative to the first component about a first axes and pivotal relative to the second component about a second axis, the two axis being parallel to each other, parallel to the predetermined direction, and offset relative to each other.

8 Claims, 2 Drawing Sheets

ACTUATING MECHANISM FOR A SLIDABLE NOZZLE RING

SUMMARY OF THE DRAWINGS

An embodiment of the present invention will now be described, by way of example, with reference to the accompanying drawings, in which.

DESCRIPTION OF THE INVENTION

Figure 1:
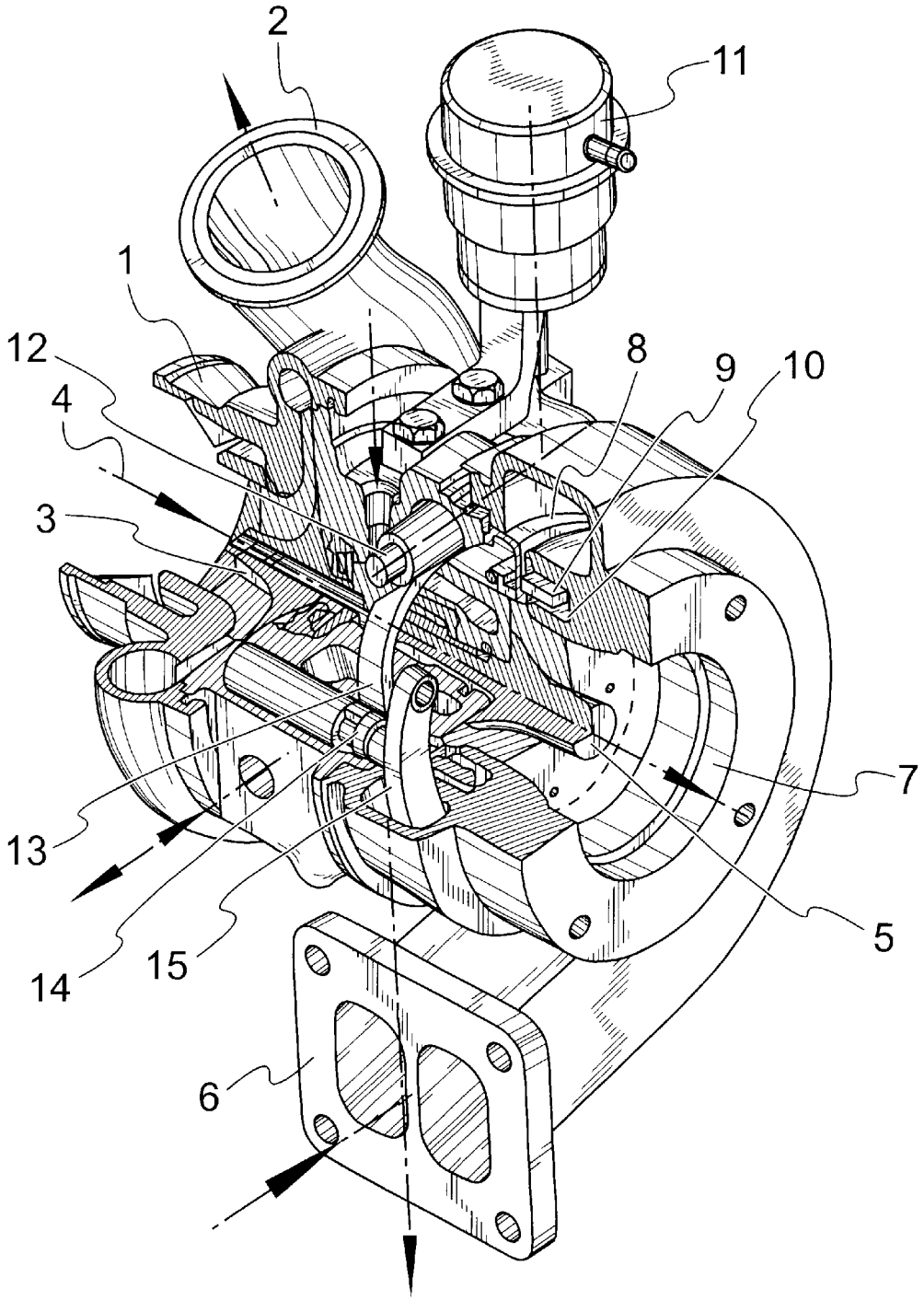
FIG. 1 is a cut-away perspective view of a variable geometry turbocharger incorporating a linkage in accordance with the invention.

Referring to FIG. 1, the turbocharger comprises an air inlet 1 and an air outlet 2 connected to a chamber in which a compressor wheel 3 is mounted to rotate about an axis 4. The wheel 3 is mounted on a shaft which extends into a turbine housing and supports a turbine wheel 5 such that the wheels 3 and 5 rotate about the common axis 4. The wheel 5 is located in a chamber interconnecting an exhaust inlet 6 and an exhaust outlet 7. Exhaust gases flowing into the inlet 6 and out of the outlet 7 drive the turbine wheel 5 which in turn drives the compressor wheel 3. Such an arrangement is conventional.

Exhaust gas flows radially inwards to the turbine wheel 5 between a nozzle ring 8 and a facing radial surface defined by the turbine housing. Vanes 9 mounted on the nozzle ring extend into a recess 10 defined in the turbine housing and facing the nozzle ring. In FIG. 1, the nozzle ring 8 is shown as defining a minimum gap between itself and the facing surface of the turbine housing. The axial position of the nozzle ring is controlled by an actuator 11 connected by a lever system to a bar 12 upon which a C-shaped yoke 13 is mounted. The ends of the C-shaped yoke engage in a pair of rods 14 only one of which is visible in FIG. 1. The other rod 14 is located symmetrically with respect to the rod 14 shown in FIG. 1. That is to say the longitudinal axis of the other rod 14 is in the same plane as that for the rod 14 shown in FIG. 1 and the axis 4 of the turbine wheel 5. In addition, the longitudinal axis of the rods 14 and equidistant from the axis 4. Each of the rods 14 is connected to a transverse arcuate component 15 (hereinafter referred to as a foot) which in turn is connected to the nozzle ring 8. Each rod 14 is slidably received within a suitable bush mounted in the housing. Thus it will be appreciated that each rod 14 is axially displaceable and can rotate about its axis relative to the housing.

Figure 2:
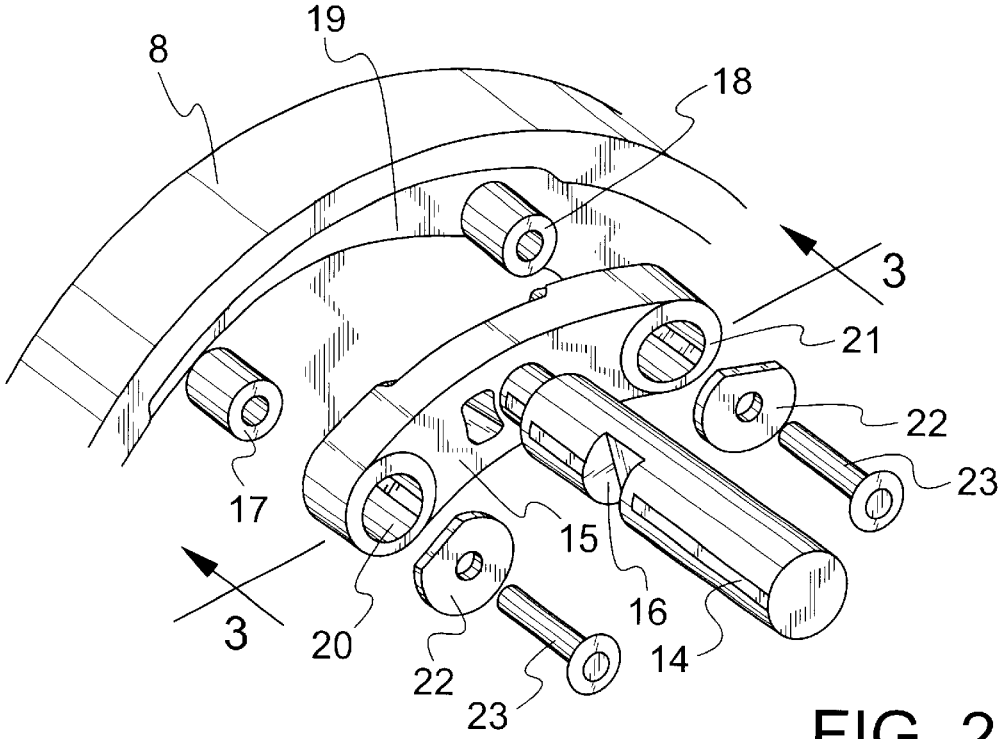
FIG. 2 is an exploded perspective view of component parts of the linkage incorporated in the structure illustrated in FIG. 1.

Referring to FIG. 2, this illustrates the linkage interconnecting the nozzle ring 8 and the rods 14. Each of the rods 14 defines a notch 16 in which a respective one of the ends of the yoke 13 of FIG. 1 engages. FIG. 2 shows only part of the nozzle ring 8 and one of the actuator rods 14 the axial position of which controls the position of the ring. The opposite section of the ring 8 to that shown in FIG. 2 is connected to an identical actuator rod linkage.

The nozzle ring 8 supports a limiting stop 17, which is in the form of an annular sleeve, and a cylindrical pivot 18 extending from an inwardly extending radial flange 19 of the ring 8. The foot 15 has a curvature matching that of the nozzle ring 8 and is provided with bores 20 and 21 at its ends. The bores 20 and 21 are positioned on the foot 15 such that they can be aligned with the stop 17 and pivot 18. The rod 14 is secured to a central portion of the foot 15.

Figure 3:
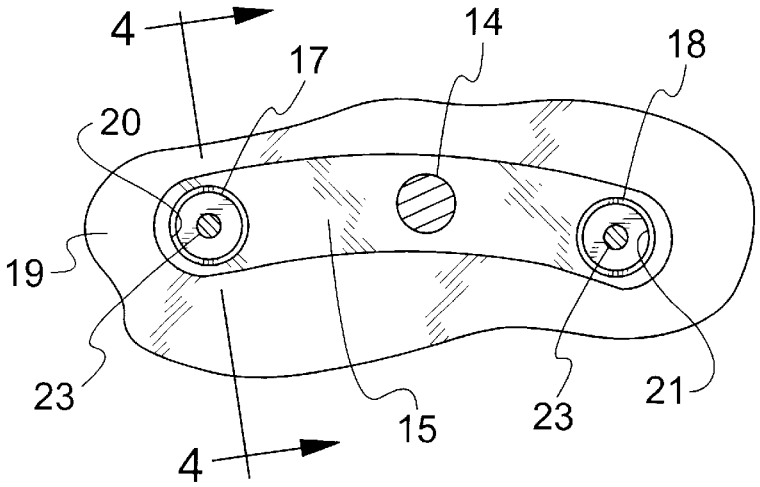
FIG. 3 illustrates a sectional view of FIG. 2, taken on plane 3–3.
Figure 4:
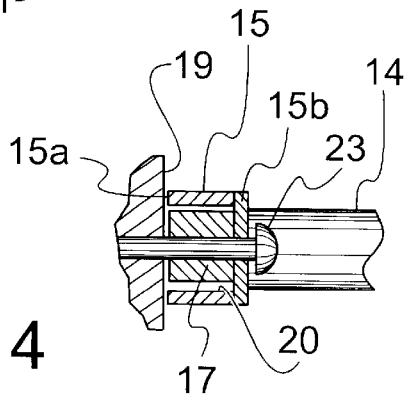
FIG. 4 is a fragmentary sectional view taken on lines 4–4 of FIG. 3.

The stop 17 and pivot 18 are secured to the nozzle ring 8 by washers 22 and rivets 23. The foot 15 is retained between the flange 19 of the ring and the washers 22. The pivot 18 is a close fit in the bore 21. In contrast, the stop 17 is a loose fit in the bore 20. Accordingly the foot 15 can rotate on the pivot 18 to an extent determined by the clearance between the stop 17 and the wall of the bore 20 as shown in FIGS. 3 & 4, a first end face 15*a* of the foot 15 bears against the flange 19 of the nozzle ring. Given the relatively large surface area of the foot in contact with the nozzle ring a significant bearing area is defined between the components and as a result wear between the contacting surfaces will not rapidly result in the nozzle ring being free to move axially relative to the rod 14. Similarly, the second end face 15*b* of the foot 15 remote from the nozzle ring flange 19 runs against the washers 22 which are held against the ends of the stop 17 and pivot 18 by the rivets 23. Again the contact areas are relatively large so that wear rates are reduced to acceptable levels. A further benefit of the illustrated design is that a bearing of increased dimensions can be provided to carry the torsional loads on the nozzle ring that result from acceleration of the exhaust gas flowing across the face of the nozzle ring.

It will be appreciated that, assuming two substantially identical rod assemblies are provided which are located symmetrically about the center of the nozzle ring, if the ring expands more than the housing the differential expansion will be accommodate by the feet 15 pivoting in the radially inwards direction and vice versa. It will also be appreciated that a single linkage as illustrated in FIG. 2 could be used with a second linkage which provides only for pivotal movement of the ring about a single bearing defined by the other rod. Alternatively, three or more linkages of the type illustrated could be used. If three of more such linkages were used, the linkages would prevent any displacement of the axis of the nozzle ring in a transverse direction.

Although the illustrated embodiment of the invention interconnects a ring and axially displaceable rods, it will be appreciated that the linkage of the invention could be used in circumstances where for example a ring was to be connected to fixed rods or the like.

What is claimed is:

1. In a turbomachine having a turbine inlet, a linkage assembly comprising: [@000a]n annular nozzle ring incorporated into said turbine inlet, said nozzle ring having a central axis and guided for movement parallel to said central axis, [@000a]t least one rod guided for movement in a direction parallel to the central axis of said annular nozzle ring, and [@000a] linkage mechanism connected to one end of said rod and pivotally connected to said annular nozzle ring, said rod being pivotal with respect to the central axis of said rod.

2. Apparatus as claimed in claim 1 wherein said linkage mechanism comprises a foot member having a first end face abutting said annular nozzle ring and a second end face fixed to said rod, one end of said foot member being pivotally connected to said annular nozzle ring on the first end face of said foot member.

3. Apparatus as claimed in claim 2 further comprising means for limiting the pivotal movement between said foot member and said annular nozzle ring.

4. Apparatus as claimed in claim 3 wherein said means for limiting pivotal movement of said foot member relative to said annular nozzle ring comprises a stop connected to the annular nozzle ring and extending through said first and second end faces of said foot member, said foot member having a bore through which said stop extends with sufficient clearance to provide a range of pivotal movement.

5. Apparatus claimed in claim 4 wherein the bore is adjacent one end of said foot member and the pivotal connection to said annular nozzle ring is adjacent the opposite end, the connection to said rod being intermediate the ends of said foot member.

6. Apparatus as claimed in claim 5 wherein the pivotal mounting comprises a cylindrical pivot connected to said annular nozzle ring and extending through a bore in said foot member.

7. Apparatus as claimed in claim 6 further comprising washers on said cylindrical pivot and annular stop for retaining said foot member and rivets extending through said cylindrical pivot and annular stop for connecting them to said annular nozzle ring.

8. Apparatus as claimed in claim 2 wherein said foot is arcuate in form with substantially flat first and second end faces.

* * * * *

UNITED STATES PATENT AND TRADEMARK OFFICE

CERTIFICATE OF CORRECTION

PATENT NO. : 6,401,563 B1
APPLICATION NO. : 09/202733
DATED : June 11, 2002
INVENTOR(S) : Philip C. Franklin It is certified that error appears in the above-identified patent and that said Letters Patent is hereby corrected as shown below:

In the Claims:

At col. 2, line 53 (line 2 of claim 1), please replace "[@000a]n" with --an--.

At col. 2, line 56 (line 5 of claim 1), please replace "[@000a]t" with --at--.

At col. 2, line 58 (line 7 of claim 1), please replace "[@000a]" with --a--.

Signed and Sealed this
Fourteenth Day of May, 2013

Teresa Stanek Rea
*Acting Director of the United States Patent and Trademark Office*